US011029028B2

(12) United States Patent
Bengtson et al.

(10) Patent No.: US 11,029,028 B2
(45) Date of Patent: Jun. 8, 2021

(54) GAS TURBINE ANNULAR COMBUSTOR ARRANGEMENT

(71) Applicant: Siemens Aktiengesellschaft, Munich (DE)

(72) Inventors: Karl Bengtson, Linköping (SE); Henrik Hull, Schweden (SE); Daniel Lörstad, Finspang (SE)

(73) Assignee: Siemens Energy Global GbmH & Co. KG, Munich (DE)

( * ) Notice: Subject to any disclaimer, the term of this patent is extended or adjusted under 35 U.S.C. 154(b) by 265 days.

(21) Appl. No.: 16/302,010

(22) PCT Filed: May 19, 2017

(86) PCT No.: PCT/EP2017/062115
§ 371 (c)(1),
(2) Date: Nov. 15, 2018

(87) PCT Pub. No.: WO2017/207301
PCT Pub. Date: Dec. 7, 2017

(65) Prior Publication Data

US 2019/0162412 A1 May 30, 2019

(30) Foreign Application Priority Data

May 31, 2016 (EP) ..... 16172220

(51) Int. Cl.
*F23R 3/02* (2006.01)
*F23R 3/00* (2006.01)
(Continued)

(52) U.S. Cl.
CPC ..... *F23R 3/005* (2013.01); *F23R 3/002* (2013.01); *F23R 3/06* (2013.01); *F23R 3/10* (2013.01);
(Continued)

(58) Field of Classification Search
CPC ..... F23R 3/002; F23R 3/50
See application file for complete search history.

(56) References Cited

U.S. PATENT DOCUMENTS 5,701,733 A * 12/1997 Lewis ..... F01D 9/023 60/796
5,722,230 A 3/1998 Cohen et al.
(Continued)

FOREIGN PATENT DOCUMENTS

CN 1464959 A 12/2003
CN 104456627 A 3/2015
(Continued)

OTHER PUBLICATIONS

International search report and written opinion dated Aug. 9, 2017, for corresponding PCT/EP2017/062115.
(Continued)

*Primary Examiner* — Gerald L Sung
*Assistant Examiner* — Marc J Amar

(57) ABSTRACT

A combustor arrangement, the combustor arrangement being annular and being arranged about an axis, the axis defining an axial direction, having an annular housing to house a plurality of burners and an annular combustion chamber, the burners arranged circumferentially about the axis inside the annular housing, wherein an annular space is defined between the housing, the burners and the annular combustion chamber, the annular space arranged to guide a compressed fluid. A plurality of stiffening plates, each arranged within the annular housing, wherein two adjacent ones of the burners are separated by one of the stiffening plates. A combustor separating wall arrangement separates the annular space from the annular combustion chamber provides openings for the burners. The stiffening plates are arranged angled and connected to the combustor separating wall
(Continued)

arrangement and two boundary walls of the housing, and further plates extend into the annular space.

17 Claims, 4 Drawing Sheets

(51) Int. Cl.

| | |
|---|---|
| ***F23R 3/50*** | (2006.01) |
| ***F23R 3/60*** | (2006.01) |
| ***F23R 3/10*** | (2006.01) |
| ***F23R 3/06*** | (2006.01) |
| ***F23R 3/26*** | (2006.01) |

(52) U.S. Cl.
CPC ..... *F23R 3/26* (2013.01); *F23R 3/50* (2013.01); *F23R 3/60* (2013.01); *F05D 2230/80* (2013.01); *F23R 2900/03041* (2013.01); *F23R 2900/03043* (2013.01); *F23R 2900/03044* (2013.01)

(56) References Cited

U.S. PATENT DOCUMENTS

| | | | | | |
|---|---|---|---|---|---|
| 5,848,874 | A * | 12/1998 | Heumann | F01D 9/042 415/189 |
| 2003/0110774 | A1 | 6/2003 | Saitoh | |
| 2004/0045301 | A1 * | 3/2004 | Farmer | F23R 3/50 60/804 |
| 2004/0250549 | A1 * | 12/2004 | Liebe | F23R 3/60 60/804 |
| 2005/0034459 | A1 * | 2/2005 | McMasters | F23R 3/002 60/752 |
| 2010/0257864 | A1 * | 10/2010 | Prociw | F02C 3/145 60/758 |
| 2011/0094233 | A1 | 4/2011 | Kashihara et al. | |
| 2012/0055164 | A1 * | 3/2012 | Bourgois | F23R 3/10 60/746 |
| 2015/0354818 | A1 * | 12/2015 | Lebel | F02C 7/28 60/796 |

FOREIGN PATENT DOCUMENTS

| | | | | |
|---|---|---|---|---|
| CN | 107003001 | A | 8/2017 | |
| EP | 1152191 | A2 * | 11/2001 | F23R 3/007 |
| EP | 2309188 | A1 | 4/2011 | |
| GB | 1108131 | A | 4/1968 | |
| RU | 2062405 | C1 | 6/1996 | |
| WO | 2016016280 | A1 | 2/2016 | |

OTHER PUBLICATIONS

EP search report dated Dec. 9, 2016, for corresponding EP patent application No. 16172220.2.

* cited by examiner

GAS TURBINE ANNULAR COMBUSTOR ARRANGEMENT

CROSS REFERENCE TO RELATED APPLICATIONS

This application is the US National Stage of International Application No. PCT/EP2017/062115 filed May 19, 2017, and claims the benefit thereof. The International Application claims the benefit of European Application No. EP16172220 filed May 31, 2016. All of the applications are incorporated by reference herein in their entirety.

FIELD OF THE INVENTION

The invention relates to a combustor arrangement, particularly of an annular combustor of a gas turbine engine, with reduced complexity.

BACKGROUND OF THE INVENTION

Gas turbine engines comprise as main components a compressor, a combustor, and an expansion turbine. For combustors, different designs exist, for example annular combustors or can-annular combustors.

In the following the problems and the proposed solution will mainly be explained for an annular combustor, but the principles may also apply to different types of combustors, particularly if several combustion components are arranged under a common casing or with a common plenum for providing air to a plurality of burners.

In a can-annular design, one can may house one combustor and this combustor comprises typically a single burner and a single combustion chamber. Several cans are present around the circumference of the gas turbine so that several combustors may be present. In theory, even though a plurality of burners and a plurality of combustion chambers exist, these could also be located within a common casing. In an annular combustor the design differs such that only one common combustion chamber is present for a plurality of burners. The burners could be encapsulated by individual hoods, i.e. a casing component around a back of the burner. Alternatively a common hood may be used to house all burners.

It is a goal to reduce complexity and therefore to reduce the number of components in the gas turbine. From that perspective an annular combustor has advantageously just a single hood to house all burners. It is typically one design goal to have a structural design with a reduced number of components—thus to reduce complexity—but meeting sufficient mechanical stiffness.

Also the material consumption shall be as low as possible as commonly expensive nickel-based alloys may be used in a combustor due to high temperatures during operation.

The hood may also be used as a plenum to provide air to the burners during operation. Furthermore a substantial demand of air may also be needed for cooling a burner tip or cooling a combustion chamber wall or liner. Thus, an additional aspect to be considered is that a proposed design should also meet all required conditions for providing a wanted amount of air to specific locations within the combustor.

Furthermore, an additional goal may be to have a combustor design that allows easy access for maintenance of the burners and the combustion chamber, e.g. possibly in a non-destructive way.

Finally, all reconfigurations of a combustor design that tries to meet the above defined boundary conditions should not negatively affect its primary function, a stable and reliable combustion.

It is therefore a goal of the invention to provide a modified combustor with a simplified design, but also considering the mentioned boundary conditions.

One example of an exemplary annular combustion chamber is shown in the patent application US 2012/055164 A1.

SUMMARY OF THE INVENTION

The present invention seeks to provide such an improved annular combustor design.

This objective is achieved by the independent claims. The dependent claims describe advantageous developments and modifications of the invention.

In accordance with the invention there is provided a combustor arrangement for an annular combustor as defined herein.

In more detail, the annular combustor is arrangeable about an axis—particularly of a gas turbine engine —, the axis defining an axial direction. The combustor arrangement comprises an annular housing—also called a hood—which houses a plurality of burners and an annular combustion chamber.

The annular housing may be a shell defined a barrier for the compressed fluid to fluidically separate an exterior of the housing from an interior of the housing. Particularly no holes are present in the housing via which compressed fluid can pass.

The combustor arrangement may be identical with an annular combustor. Thus, the combustor arrangement may also be called annular combustor arrangement. Depending on which components are considered to be part of the annular combustor, the combustor arrangement may represent the structural elements of an annular combustor, but not including piping connected to the combustor or control software for the combustor. In another interpretation the combustor arrangement also comprises the piping, the control software, sensors, and other components that are used by or connected to the combustor.

The combustor arrangement further comprises a plurality of burners. This plurality of burners is arranged circumferentially about the axis inside the annular housing, wherein an annular space is defined between the housing, the burners and the annular combustion chamber. The annular space is arranged to guide a compressed fluid. Thus, the housing may define a fluidically closed boundary. The housing may be sealed against its surroundings, besides dedicated passages for ingress and/or egress of fluid into/from the annular space.

An annular housing is typically present for combustors featuring convective cooled liners. In such design the compressed air flows in cooling channels along the liners for cooling purposes before it ingress into the annular housing. The fluid then egresses through the burners and into the combustion chamber.

The combustor arrangement further comprises a plurality of stiffening plates, each arranged within the annular housing. The plurality of stiffening plates may have any possible orientation, advantageously each arranged in a plane spanned by the axial direction and a radial direction, the latter being substantially perpendicular to the axial direction, even more advantageously the plane additionally intersecting the axis. Two adjacent ones of the burners are separated by one—advantageously a single one—of the stiffening plates.

Separating means that one of the stiffening plates is located between two burners that are adjacent to another. So the stiffening plate separates also partly the annular space into segments.

Furthermore the combustor arrangement further comprises a combustor separating wall arrangement to separate the annular space from the annular combustion chamber. The separating wall arrangement comprises openings for the plurality of burners. Particularly the openings are configured to hold the burners in position and/or to provide a connection between the burners and the annular combustion chamber. Thus, the burners may be placed each in respective ones of the openings of the separating wall arrangement.

The stiffening plates are arranged angled to, particularly substantially perpendicular to, and connected—particularly fixedly connected—to the following three components: (1) the combustor separating wall arrangement, (2) two boundary walls of the housing, and (3) further plates extending into the annular space.

The term "angled to" means particularly non-parallel.

The connection is advantageously a fixed or a locked connection.

With "fixedly connected" several connection methods are defined, for example by welding, by engaging of one component into a slot of another component, and/or by a combination of both such that extensions of one component are inserted in corresponding slots of another component and afterwards welded. Particularly a fixed connection is not a connection in which two components merely touch without having a specific means for keeping these together.

Connection at least three elements to the stiffening plates will provide sufficient stability and/or stiffness to the overall combustor arrangement. Additionally the number of components may be reduced compared to other geometries.

Furthermore this allows using fairly thin stiffening plates to gain sufficient stability of the combustor arrangement, even though these plates would be considered flexible if not connected to the other components as mentioned before.

The connection between the stiffening plates and the combustor separating wall arrangement provides support for the combustor separating wall arrangement. The combustor separation wall arrangement could otherwise possibly collapse due to a pressure difference over the wall if no connection to the stiffening plate was present.

The stiffening plates are advantageously manufactured from sheet metal. A width of the sheet metal may be between 1 mm and 10 mm. The stiffening plates may be substantially in form of a ring with an outer boundary fitted into the annular housing (therefore not following a perfect ring shape). Besides, the stiffening plates may comprise a blanked out central region.

The boundary walls may be particularly two walls of the housing that are opposite to another.

The stiffening plates and/or the boundary walls and/or other walls of the housing may also be manufactured by casting or additive manufacturing in form of a unitary piece.

In an exemplary embodiment the combustor separating wall arrangement may comprise a support ring—advantageously a plain support ring—located in the annular space, the support ring comprising the openings of the combustor separating wall arrangement to slidably hold the plurality of burners. The support ring creates a connection between the stiffening plates and the combustor separating wall arrangement. In other words, the "support ring" support the burners. It is advantageously a ring about the axis of the annular combustor or a ring made from smaller ring segments. "Plain" is meant in the sense of being flat without depressions and elevations. One embodiment would be that the plain support ring is made from sheet metal.

The connection is beneficial as the combustor separation wall arrangement could collapse otherwise due to the pressure difference over the wall if no connection to the stiffening plates were present.

The stiffening plates may therefore be connected to the support ring as one element of the combustor separating wall arrangement. The stiffening plates may be fixedly connected to the support ring. Other parts of the combustor separating wall arrangement may just be locked to the support ring—also called locking ring. Thus, the parts may be locked in the perpendicular direction while it is allowed relative motion in the plane of the combustor separating wall arrangement.

The support ring may prohibit the combustor separating wall arrangement from collapsing by the pressure difference over the separating wall but also reduces the load on an impingement panel, which also may be a further part of the combustor separating wall arrangement.

The overall ring of the support ring may have a tilted surface, particularly if also the burners are positioned in an angle in relation to the axis, i.e. not being parallel to the axis. In consequence the overall ring may have a surface that is in shape of a conical shell.

In a further exemplary the combustor separating wall arrangement may be the entity that comprises the previously mentioned openings which each hold a tip region of the burners.

Furthermore the combustor separating wall arrangement may comprise a heat shield with cooling holes, the cooling holes arranged for guiding compressed fluid into the combustion chamber.

Besides, the combustor separating wall arrangement may comprise an impingement plate substantially parallel to the heat shield and defining a cooling cavity between the heat shield and the impingement plate, the impingement plate comprising holes for impingement cooling of the heat shield, wherein the holes are arranged to be supplied with compressed air from—particularly directly from—the annular space.

Thus, cooling air for the heat shield wall may be taken directly from the annular space within the housing, i.e. the air that advantageously already has been used for cooling of liners of a combustion chamber.

Summarising the past few paragraphs, the combustor separating wall arrangement is a component that defines a fluidic barrier between the annual space and the annular combustion chamber. It defines a part of the combustion chamber wall. It also provides mechanical support for the burners. And due to the hot environment it may comprise cooling features.

In another exemplary embodiment burner rings each being located inside one of the openings of the combustor separating wall arrangement may be provided. Each of the burner rings may have a through-hole into which the tip region of the respective burner is mounted. So the burner ring is a component transition piece between the combustor separating wall arrangement and the burners.

As an example the stiffening plates and the impingement plate—as one part of the combustor separating wall arrangement—may be connected fixedly to another. Further, the impingement plate may be slidably locked—not fixedly connected—to the burner ring and also slidably locked to the heat shield—the heat shield being another part of the combustor separating wall arrangement. Thus, the impingement plate may be locked to the burner ring and heat shield in the perpendicular direction while may allow relative motion in the plane of the combustor separating wall arrangement. This design prohibits the combustor separating wall arrangement from collapsing by the pressure difference over the combustor separating wall arrangement but still allow relative thermal displacements between the impingement plate and heat shield.

In a further embodiment each of the burner rings may comprise elongated effusion cooling holes directed onto the tip region of the respective burner, particularly onto a front face of the tip region of the respective burner and/or into a groove between a rim of the respective burner ring and the tip region of the respective burner. "Elongated" in this respect defines a passage that is not a shortest length through-hole through a part of the burner rings but defines the passage with a length of at least 150% of the shortest possible passage through that part. Thus, considering the burner ring comprises a flat section with two opposing surfaces, the elongated effusion cooling holes are angled in respect of one or both of the two opposing surfaces. Another definition of "elongated" in the scope of the text is that the length of the elongated effusion cooling hole compared to a medium diameter of the elongated effusion cooling hole is more than 10 to 1, particularly more than 20 to 1. It may even be above the rate of 30 to 1.

This just explained configuration allows the compressed cooling air to be used both for cooling of burner ring and a burner tip region. The cooling air may be taken from a cavity between the impingement plate and the heat shield or it may be taken directly from the annular space.

The effusion holes may be positioned at a location of increased or highest heat load during operation. Cooling may be concentrated to this region. The long cooling hole design allow effective use of the cooling air passing through.

A piston ring may be present between a surface of the burner ring and a corresponding surface of the tip region of the burner. This may provide a sealing effect with minimised cooling air consumption.

The piston rings may be positioned in a slot machined in a surface of the burner tip.

As said, the elongated effusion cooling holes may particularly be directed onto a front face of the tip region of the respective burner. Outlets of the holes are advantageously positioned so that the cooling air is released to give an impingement effect on the burner tip.

The elongated effusion cooling holes may particularly be directed into a groove between a rim of the respective burner ring and the tip region of the respective burner. A groove may be advantageous as this guarantees that outlets of some of the elongated effusion cooling holes are not blocked. The reason is that due to gravity and other forces, the burner may not be perfectly centered in the burner ring but rather lie against the burner ring on one side and could, without a groove, block the cooling holes in that position. To solve this and ensure a cooling flow through all holes at all times, a groove may be introduced at the outlet of the holes.

The effusion holes may be position along a circle with equidistant distances between the holes. The outlets of the effusion holes have an impingement cooling effect on the burner before the air ends up into the combustion chamber.

In the following embodiments air to the annular space may be provided via dedicated passages, for example two annular ducts along a radial inwards and radial outwards shell of the combustion chamber.

In one specific embodiment the previously mentioned further plates may comprise at least a barrier penetrating the annular space such that cooling air from a combustion chamber liner is guided to an axial mid region of the annular space, advantageously the barrier being a liner extension plate of the liner of the combustion chamber. The liner may be a convective liner, for example a double shell liner. "Axial" takes reference to the previously mentioned axis, i.e. the axis of the gas turbine engine or alternatively an axis of symmetry of the burners.

"Axial mid region" means that the barrier extends into the annular space with a sufficient length so that the provided cooling air does not travel immediately to an inlet of the burner or to a burner tip but travels throughout the annular space.

The length of the barrier may be configured such that air is provided to an air inlet of the burners—for example via a swirler—without recognisable turbulences within the annular space.

As one embodiment the liner extension plate and the liner—the inner wall facing the combustion chamber—of the combustion chamber are angled to another via an obtuse angle $\alpha$ between 155° and 180° (meaning a bent between 25° and 0°). In a further embodiment the angle $\alpha$ may be additionally greater than 165° or 175°. By this angle $\alpha$ a space of the annular space in front of the combustor separating wall arrangement may continuously be narrowed when getting closer to the combustor separating wall arrangement. In the same way a diffuser between the liner extension plate and a further wall of the annular housing is continuously widening in flow direction of the cooling air.

The further wall—possibly one of the previously introduced boundary walls (or outer walls) or a section of that boundary wall—may be arranged in relation to the barrier such that a diffuser is formed to convert dynamic pressure of the provided air back to static pressure before the air exhausts into the annular housing.

Particularly, the further wall—also acting as a cooling panel—and the liner of the combustion chamber may define a cooling fluid passage therebetween—particularly for convective cooling—with a cooling fluid passage cross-section, the cooling fluid passage leading into the diffuser, the diffuser being defined by one of the two boundary walls of the housing and the liner extension plate.

The diffuser geometry may be selected with sufficient margin to separation in order not to be sensitive to flow disturbances and pressure oscillations which may occur during operation.

In another exemplary embodiment the liner extension plate and the liner and optionally also the combustor separating wall arrangement are connected via bolts. Preferably bolt heads of the bolts may extend into the diffuser and/or threads of the bolts extend into the annular space. Furthermore the bolts may be fastened via nuts applied from the annular space. The bolts may be arranged in radial orientation. All these options allow easy dismantling for repair, but without having substantial negative effect on the air flow, as the bolt connection may only have a small impact on the cooling fluid passages with respect to pressure losses and/or blockage of the cooling fluid passage. Thus low pressure losses in the diffuser can be reached. Alternatively, the bolt heads of the bolts may extend into the diffuser and/or threads of the bolts extend into the cooling fluid passage.

In an embodiment the barrier—i.e. the liner extension plate—may provide an axial stop for engaging the liner with the barrier. This allows for accurate axial positioning of the liners in respect of the barrier and/or of the combustor separating wall arrangement.

Furthermore an extension sleeve may be provided for each of the bolts positioned between one of the nuts and the barrier for providing continuous strain on the bolt. This provides sufficient margin on the bolt strain so the bolts would not get loose due to settling or break in response of potential too high thermal stresses.

In yet another exemplary embodiment rope seals or brush seals may be used to minimize eventual leakage through the bolted connection. In other words, a contact region between connection of the liner extension plate and the liner and optionally also the combustor separating wall arrangement are sealed by means of rope seals or brush seals in order to minimize leakage from the annular housing to the annular combustion chamber through the contact region.

A further embodiment focuses at the other end of the liner of the combustion chamber. An inlet into the cooling fluid passage is defined by a section of the further wall smoothly becoming substantially parallel, in respect of a cooling fluid flow direction along the liner during operation, to the liner of the combustion chamber. That means a smooth entrance to the cooling fluid passage is provided to minimise pressure losses in that region.

The different embodiments allow a simplified design of a combustor considering also stability of the structure, material costs, complexity for service access, and cooling.

The invention is also directed to a gas turbine engine with a combustor arrangement as defined before. Furthermore the invention is also to a method of manufacturing of such a combustor arrangement, a method of dismantling such a combustor arrangement, and a method of operation of such a combustor arrangement.

It has to be noted that embodiments of the invention have been described with reference to different subject matters. In particular, some embodiments have been described with reference to apparatus type claims whereas other embodiments have been described with reference to method type claims. However, a person skilled in the art will gather from the above and the following description that, unless other notified, in addition to any combination of features belonging to one type of subject matter also any combination between features relating to different subject matters, in particular between features of the apparatus type claims and features of the method type claims is considered as to be disclosed with this application.

The aspects defined above and further aspects of the present invention are apparent from the examples of embodiment to be described hereinafter and are explained with reference to the examples of embodiment.

BRIEF DESCRIPTION OF THE DRAWINGS

Embodiments of the invention will now be described, by way of example only, with reference to the accompanying drawings, of which.

The illustration in the drawing is schematic. It is noted that for similar or identical elements in different figures, the same reference signs will be used.

Figure 1:
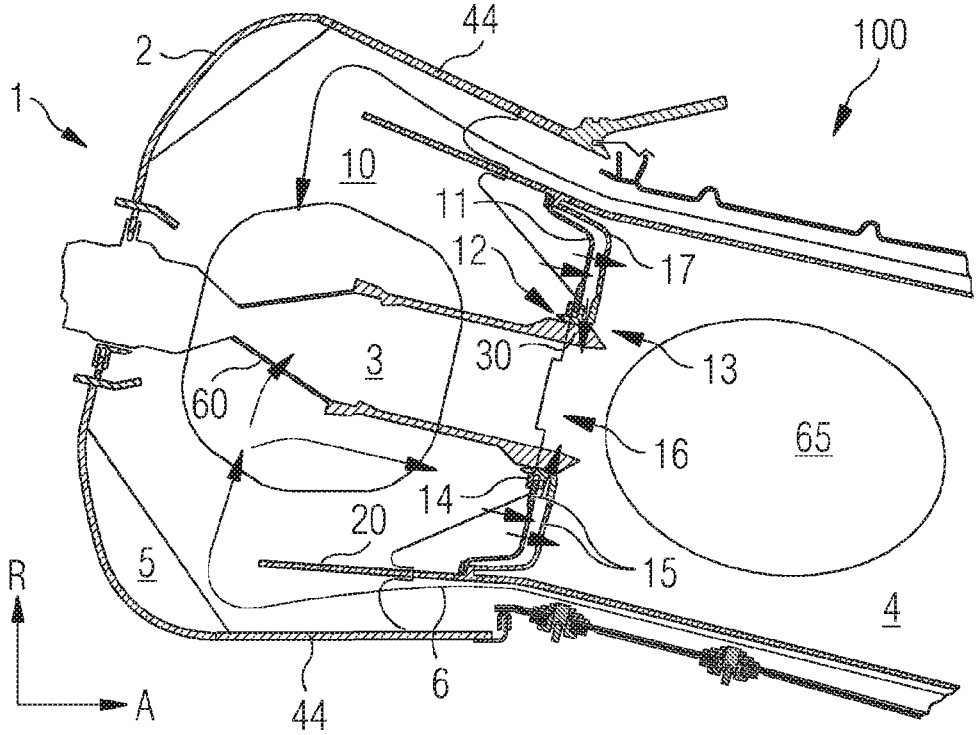
FIG. 1: shows schematically a cross sectional view of an exemplary inventive combustor arrangement taken at a plane through an axis of a gas turbine.

Some of the features and especially the advantages will be explained for an assembled gas turbine, but obviously the features can be applied also to the single components of the gas turbine but may show the advantages only once assembled and during operation. But when explained by means of a gas turbine during operation none of the details should be limited to a gas turbine while in operation.

DETAILED DESCRIPTION OF THE INVENTION

In the following a combustor arrangement of a gas turbine engine is discussed.

To explain the principle, the gas turbine engine comprises, in flow series, an air inlet (not shown), a compressor section (not shown), a plurality of burners (only one burner shown in the figures in an abstract way), a combustion chamber—according to the figures an annular chamber is depicted —, an expansion turbine (not shown), and an exhaust (not shown). The compressor, the combustor comprising the burners and the combustion chamber, and the expansion turbine are generally arranged in flow series within a casing.

In the following an arrangement of an annular combustion chamber and a plurality of burners connected to the annular combustion chamber, including further components and surrounding walls, will be called an annular combustor 100.

The gas turbine engine is generally arranged about a rotational axis, which is the rotational axis for rotating components, in particular the compressor and the expansion turbine. The rotational axis is also coincident with the axis of symmetry of the annular combustor 100.

In operation of the gas turbine engine, air provided via the inlet is compressed by the compressor and a main portion of the compressed air is delivered to the annular combustor 100. The compressed air exiting from the compressor and flowing towards the combustion section is schematically represented in the attached figures by arrows. A main amount of the compressed air enters the burners where it is mixed with a gaseous or liquid fuel. The air/fuel mixture is then burned and the resulting combustion gas from this combustion is channelled through the combustion chamber to the expansion turbine, for transforming the energy from the operative air/fuel mixture into working power, leading to a rotation of the rotor or of several rotors.

In the following the terms radial, circumferential and axial are with respect to the rotational axis of the gas turbine engine. Even though the rotational axis is not depicted in the attached figures, the orientation is indicated in the figures as axial direction A, radial direction R, and circumferential direction C, all of these directions being perpendicular to another. If the circumferential direction C is perpendicular to the drawing plane of the respective figure then it is not indicated in the figure.

Referring now to FIG. 1, a combustor arrangement 1 is shown in a cross sectional view in a drawing plane defined by the axial direction A and the radial direction R. This arrangement is part of an annular combustor 100 or is possibly even identical to the annular combustor 100. An annular combustion chamber 4 is shown partly shown on the right hand side of FIG. 1. The annular combustion chamber 4 is surrounded by a dual wall liner. A burner 3—a single one of a plurality of burners that are arranged circumferentially about the axis of the gas turbine engine—is depicted in an abstract way with an opening into the annular combustion chamber 4. The burner 3 may comprise a swirler 60, a mixing zone, means for providing fuel, and slots—typically within the swirler 60—via which air is provided (most of these components are not explicitly highlighted in FIG. 1). The burners 3 may be arranged primarily in axial direction A, possibly slightly angled as shown in the figure. The burners 3 are located within an annular housing 2. The annular housing 2 holds advantageously all of the burners 3.

It has to be understood in the abstract drawing of FIG. 1 that the shown burner 3 is itself not an annular part about the rotational axis of the gas turbine engine, but each burner 3 is a self-contained component and a plurality of these separate burners 3 are arranged about the rotational axis. On the other hand, the combustion chamber 4 and the annular housing 2 are annular in configuration.

The annular housing 2 can also be called "hood" for the set of burners 3. The annular housing 2 defines an annular space 5 in which the burners 3 are positioned. The annular space 5 is a region via which compressed fluid 6—typically compressed air—is guided, particularly to the burners 3 for combustion and to further components for cooling. Outside the annular housing 2 typically also compressed cooling air is present. There may be also configurations in which ambient air surrounds the annular housing 2.

Another separator of the annular space 5 is shown by a combustor separating wall arrangement 15. The combustor separating wall arrangement 15 is a separating barrier between the annular space 5 and the annular combustion chamber 4. The combustor separating wall arrangement 15 provides openings 16, each opening 16 to hold tip regions 30 of the burners 3.

The combustor separating wall arrangement 15 as defined in FIG. 1 comprises a double wall configuration of a heat shield 17 and an impingement plate 11. In between the heat shield 17 and the impingement plate 11 a cooling cavity is formed. Cooling air for the cooling cavity is solely provided via holes in the impingement plate 11. The holes are implicitly shown via a depicted arrow of cooling air passing through the impingement plate 11. Cooling air passing through the impingement plate 11 will impinge on a back face of the heat shield 17. The heat shield 17 has also cooling holes via which cooling air can travel into the annular combustion chamber 4. Again these holes are only indicated by an arrow for air travelling through the heat shield 17. To have a proper impingement effect, the holes of the impingement plate 11 are displaced in respect to the positions of the cooling holes of the heat shield 17.

The impingement plate 11 is boundary for the annular space 5. The heat shield 17 is boundary for the annular combustion chamber 4.

The annular housing 2 comprises two boundary walls 44 (or outer walls) that are substantially opposite to another and close the annular space 5 from a radial inwards and radial outwards direction.

Stiffening plates 10—only one is shown in FIG. 1—are arranged within the annular space 5. The shown stiffening plate 10 of FIG. 1 is arranged in the drawing plane, defined by the axial direction A and a given radial direction R. It may also be angled though (which is not shown in the figures). The stiffening plates 10 may have several fixed connections to components surrounding the annular space 5. Two fixed connections are provided to both of the boundary walls 44. A further fixed connection is provided to the impingement plate 11, i.e. to the combustor separating wall arrangement 15. This supports the impingement plate 11 so that it will not collapse. Besides, the stiffening plate 10 may also be connected to a first further plate 20 or liner extension plate, particularly to a pair of first further plates 20. The liner extension plates (the first further plates 20) each are arranged substantially opposite each of the boundary walls 44. The liner extension plates (the first further plates 20) extend into the annular space 5 as a ledge which ends in a mid region of the annular space 5.

The fixed connections may be provided by welding. Additionally or alternatively the components may be inserted into another such that an extension is inserted into a slot. Afterwards the components may be welded as well.

The combustor separating wall arrangement 15 may also comprise a plurality of burner rings 12, one per burner 3. The burner ring 3 may be fixedly connected to the heat shield 17 and locked slidably to the impingement plate 11 by a locking ring 14 (see also FIG. 5 in more detail). The locking ring 14 is fixedly connected to the burner ring 12 and supports the combustor separating wall arrangement 15 in the direction perpendicular to the combustor separating wall arrangement 15 while it allows relative motion of the impingement plate 11 and the heat shield 17 in their plane of expanse. By this it provides sufficient stiffness of the combustor separating wall arrangement 15 but still allow for relative thermal displacements between impingement plate 11 and the heat shield 17. Only one burner ring 12 is shown in FIG. 1. The burner ring 12 has a wall that is substantially in form of an inner cylinder with a limited length—i.e. a ring—and allows connecting the one of the burners 3 at the tip region 30 of the burner 3 into the combustor separating wall arrangement 15. The tip region 30 will protrude via the burner ring 12 into the annular combustion chamber 4. So the burner ring 12 defines a through-hole to hold the tip region 30 of the burner 3.

The combustion chamber 4 is surrounded by a dual liner through which compressed fluid 6 is guided, advantageously in a direction reverse to main fluid flow of the combusted mixture. The compressed fluid 6 then is guided between a pair of the first further plate 20 and the boundary wall 44. The pair of the first further plate 20 and the boundary wall 44 may form a diffuser for the compressed fluid 6 before entering the annular space 5.

A main fraction of the compressed fluid 6 may be led to the burner 3, particularly to slots of a swirler 60 of the burner 3, as indicated by an arrow in the drawing. Another fraction of the compressed fluid 6 will be guided through the annular space 5 and the outside of the burner 3 for cooling purposes so that the compressed fluid 6 is provided to the impingement plate 11 and burner tip 30.

The stiffening plates 10 may be flat metal components, advantageously made of sheet metal, with a blanking or cutting in the centre. The blanking may be substantially circular. The blanking may be in a region adjacent to the swirler 60 of the burner 3. This allows pressure variations within the annular casing 5 to even out and allows free travel of compressed fluid 6 so that the compressed fluid 6 is provided from all circumferential directions of the swirler 60.

An elongated effusion cooling hole 13 is indicated abstractly as an example of a plurality of these holes arranged about the circumference of the burner ring 12. This will be explained in more detail in relation to FIG. 5.

Figure 2:
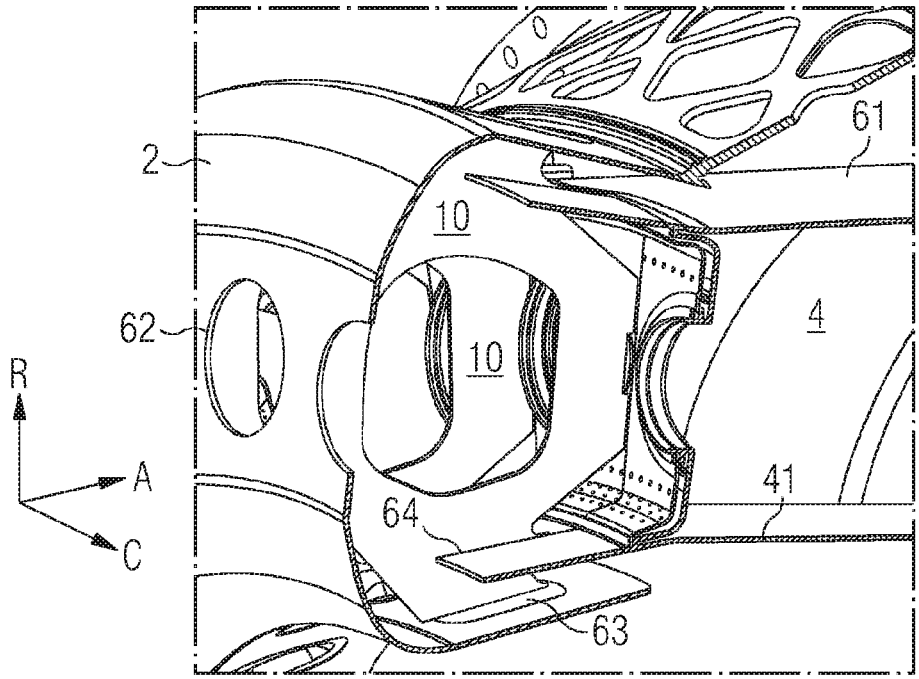
FIG. 2: illustrates a three-dimensional view of the same embodiment as shown in FIG. 1, showing also the cross section of FIG. 1.

FIG. 2 shows an angled view of FIG. 1 with an identical configuration but without depicting the burners 3. The sectional view of FIG. 1 is also shown again in FIG. 2.

Among others, the stiffener plates 10, the annular housing 2 and the combustor separating wall arrangement 15 are shown again in the figure. Also a combustion liner 41—an inner wall of a dual wall liner—is shown for convective cooling on a back surface of the combustion liner 41. An outer wall of the dual wall liner is not depicted in this view.

An opening 62 within the hood—i.e. the annular housing 2—for each burner 3 is shown. Via this opening 62 the fuel supply lines may be located to provide fuel to the respective burner 3. More importantly in scope of this invention, via this opening 62 the burner 3 can easily be removed for maintenance.

Besides, one of the fixed connections is shown by the welded connection 63 between the stiffening plate 10 and the boundary wall 44. A further fixed connection 64 is indicated between the stiffening plate 10 and the liner extension plate (the further plate 20).

No specific cooling channels are needed to supply the cooling cavity in between the heat shield 17 and the impingement plate 11. The impingement plate 11—or impingement panel—is fixedly connected to the stiffeners (the stiffening plates 10) between the burner rings 12 which are locked to the impingement plate 11 and the heat shield 17. The compressed fluid 6, i.e. compressor discharge air—flows through a cooling channel of the convective dual wall liner along the combustion chamber liner 41 and exhausts into the hood—the annular housing 2. Cooling air for the heat shield 17 is taken directly from the hood.

Thus, the impingement plate 11 is not only used for cooling purposes but also to take some load and give support to the burner rings 12 and heat shield 17. No separate air feed for the heat shield 17 cooling.

Effusion holes are introduced in the burner ring 12 in the region with highest heat load. This may be explained later in more detail. By this design the burner ring can be made fairly short.

The burners 3 are provided with a sufficient amount of compressed fluid 6 to mix with fuel. As main fuel possibly gaseous fuel is provided. Other types of fuels may be possible. When leaving a space of the burner 3, the fuel/air mixture is combusted within the combustion chamber 4. A flame 65 is indicated in an abstract way in FIG. 1.

According to FIGS. 1 and 2 each of the plurality of stiffening plates 10, are arranged in a plane spanned by the axial direction A and a radial direction R in respect of the gas turbine rotor axis, the radial direction R being substantially perpendicular to the axial direction A. The stiffening plates 10 are fixedly connected to the combustor separating wall arrangement 15 by a connection to the impingement plate 11, to the two opposite boundary walls 44 of the housing 2, and to the first further plate 20 (the liner extension plate) extending into the annular space 5. Additionally, the stiffening plates 10 are arranged substantially perpendicular—or angled (not shown)—to the combustor separating wall arrangement 15—i.e. perpendicular to the impingement plate 11 —, to the two boundary walls 44 of the housing 2, and to the first further plate 20 (the liner extension plate) extending into the annular space 5. The two components may divert from a perfect perpendicular orientation less than 20°. But also other angles can provide sufficient stiffness.

Figure 3:
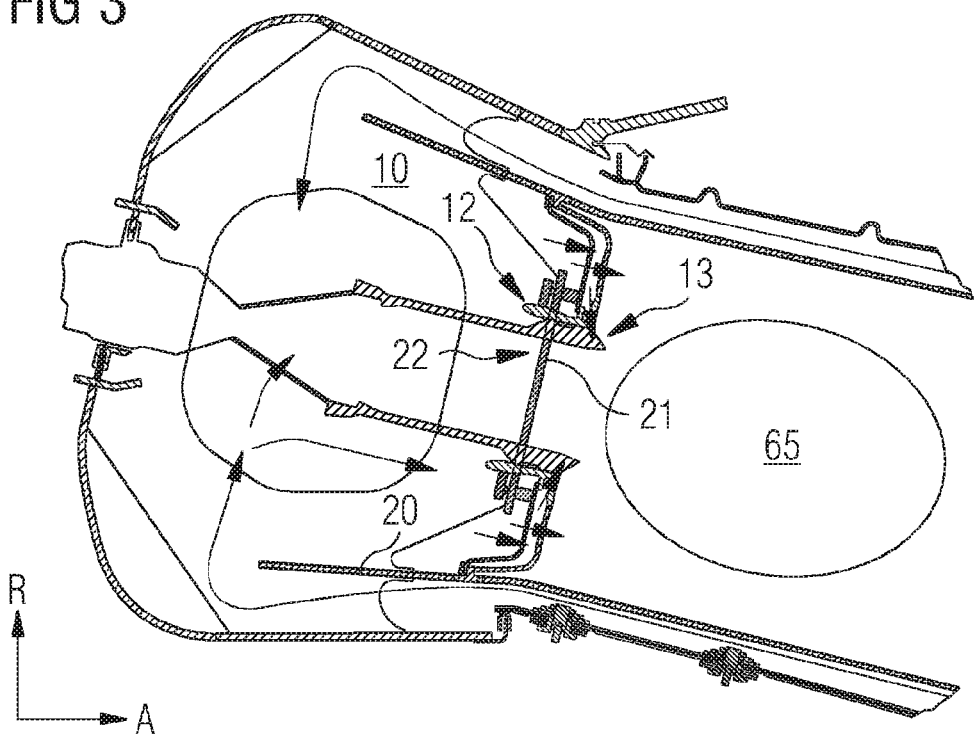
FIG. 3: shows schematically a cross sectional view of an alternative exemplary inventive combustor arrangement taken at a plane through an axis of a gas turbine.

Turning to FIG. 3, the configuration is quite similar, so that not all elements are mentioned again that remain unchanged compared to FIG. 1. In FIG. 3 the connection of the stiffening plates 10 to the impingement plate 11 is replaced such that a support ring 22 as an example for a second further plate 21 (in the figure elements 21 and 22 identify the same part) provides the connection between the stiffening plates 10 and the combustor separating wall arrangement 15.

The support ring 22 is a ring that about the axis of the annular combustor or about the axis of the gas turbine engine. The support ring 22 may be a flat ring or may be conical and/or segmented, when the overall shape of the ring is considered. In FIG. 3 the support ring 22 would be conical. The support ring 22 may be made from sheet metal. The support ring 22 may be considered to be part of the combustor separating wall arrangement 15 and is connected to the other parts of the combustor separating wall arrangement 15, for example by a locking ring fixedly connected—e.g. welded—to the burner ring 12, and the burner ring 12 again is connected to the impingement plate 11. Another form of fixation may be used. The support ring 22 has blanked out holes through which the tip region 30 of the burners 3 may reside when assembled.

The support ring 22 is advantageously welded via a welded connection 63 to the stiffening plates 10. The burner rings 12 may be locked—advantageously in an unlockable fashion—to the support ring 22.

The support ring 22 provides additional stiffness to the overall construction and reduces mechanical loads on the impingement plate 11.

The combustor separating wall arrangement 15, the two boundary walls 44 of the housing 2, and the further plates 20, 21 are individually manufactured elements. They are separate elements that are connected together during assembly of the combustor arrangement. Particularly these are not merely different sub sections of a common sheet metal.

In consequence, the stiffening plates 10 are fixedly connected to the combustor separating wall arrangement 15 by a connection to the support ring 22, to the two boundary walls 44 of the housing 2, and to the first further plate 20 (i.e. the liner extension plate) extending into the annular space 5. Additionally, the stiffening plates 10 are arranged perpendicular to the combustor separating wall arrangement 15—i.e. perpendicular to the support ring 22—, to the two boundary walls 44 of the housing 2, and to the first further plate 20 extending into the annular space 5.

Figure 4:
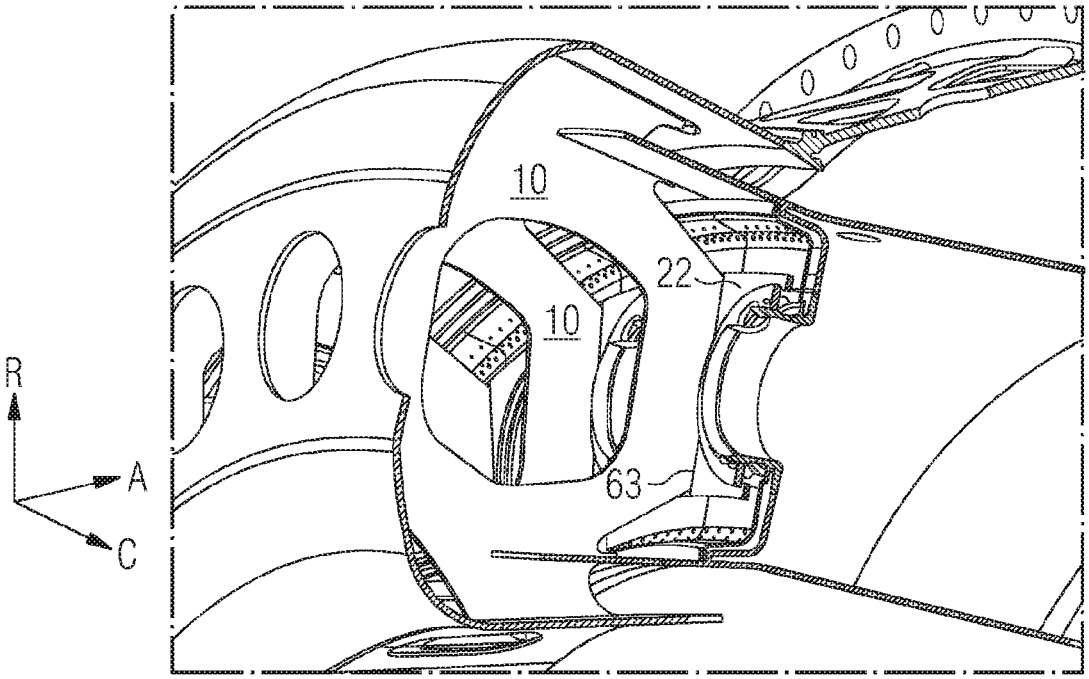
FIG. 4: illustrates a three-dimensional view of the same embodiment as shown in FIG. 3, showing also the cross section of FIG. 3.

FIG. 4 now shows an angled view of FIG. 3 with an identical configuration but without depicting the burners 3. The sectional view of FIG. 4 is also shown again in FIG. 3.

In operation, FIGS. 3 and 4 do not really differ to FIGS. 1 and 2. Compressor discharge air as compressed fluid 6 flows through a pair of convective liner cooling channels along the combustion chamber liners 41 and exhausts into the hood, i.e. in the annular space 5. The cooling air for the heat shield 17 again is taken directly from the annular space 5. As briefly mentioned before, elongated effusion cooling holes 13 may also be introduced in the burner ring 12 in a region with highest heat load.

Particular additional support struts for mechanical support to the combustor separating wall arrangement 15 are not needed. The combustor front panel shows a simple support ring 22, which is easy to manufacture. A reduced amount of material is used in this construction but gaining sufficient stiffness and sufficient cooling properties.

Figure 5:
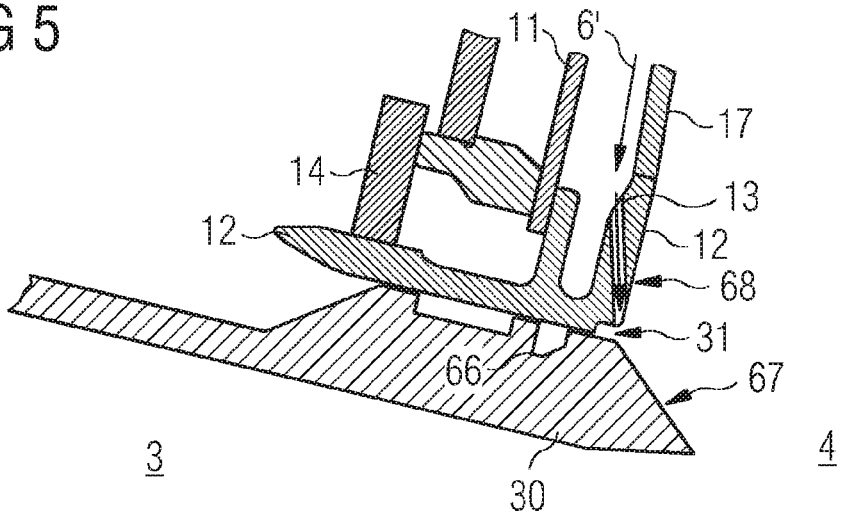
FIG. 5: shows an enlarged cross sectional view of a burner tip and a combustor separating wall arrangement as shown in the previous figures.
Figure 5:
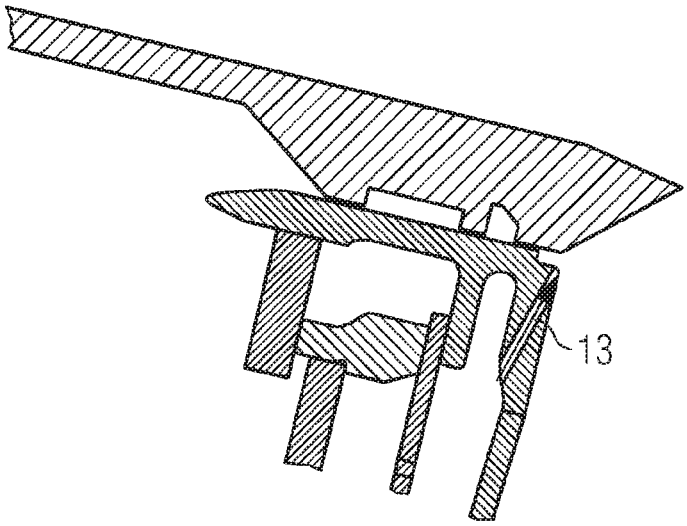

FIG. 5 now shows a detailed view of an embodiment of the tip region 30 of the burner 3 as shown in the previous figures. In the figure the burner ring 12 as shown in FIGS. 1 and 2 is depicted as an example. Alternatively also the embodiment of FIGS. 3 and 4 could have been used as the basis for FIG. 5.

In FIG. 5 the burner ring 12 is shown, to which the impingement plate 11 and the heat shield 17 are fixedly connected.

The tip region 30 of the burner 3 has a substantially cylindrical outwards surface which is in immediate contact with a substantially cylindrical inwards surface of the burner ring 12. In between a piston ring 66 may be present, which may be positioned in a slot of the cylindrical outwards surface of the tip region 30.

The burner ring 12 comprises a plurality of elongated effusion cooling holes 13, two of which are shown in the figure. The elongated effusion cooling holes 13 in the figure is angled and crosses a substantial amount of material of the burner ring 12. A front surface 68 that is pierced by the elongated effusion cooling holes 13 is facing the annular combustion chamber 4.

The tip region 30 of the burner 3 comprises a front face 67. The front face 67 is facing the annular combustion chamber 4. The front face 67 may be angled in relation to the front surface 68 of the burner ring 12.

An exit of the elongated effusion cooling holes 13 is directed onto a rim of the burner 3. Particularly the exit of the elongated effusion cooling holes 13 will be directed onto a groove 31 between a rim of burner ring 12 and the rim of the burner 3.

Cooling air to cool the burner ring 12 is compressed fluid 6' that has been used to cool the heat shield 17 and that is guided between the impingement plate 11 and the heat shield 17.

The elongated effusion cooling holes 13 are present in the burner ring 12 and may be concentrated to an area exposed to the highest heat load. These long holes allow for effective use of the cooling air. The outlets of the elongated effusion cooling holes 13 are positioned so that the cooling air is released to give an impingement effect on the burner tip (the tip region 30 and particularly an end closest to the annular combustion chamber 4).

Due to gravity and other forces, the burner 3 and also the burner tip 30 may not be centered in the burner ring 12 but rather lie against the burner ring 12 on one side with a potential risk to block the elongated effusion cooling holes 13 in that position. To solve this and ensure a cooling flow through all of the elongated effusion cooling holes 13 at all times, the groove 31 is introduced at the outlet of the elongated effusion cooling holes 13.

By this cooling scheme, the cylindrical outwards surface of tip region 30 of the burner 3 can be close contact with the substantially cylindrical inwards surface of the burner ring 12 with minimized leakage of cooling air at this interface. This may allow to further reduce the cooling air consumption. Air will egress via the elongated effusion cooling holes 13 instead.

By the long effusion holes, cooling is concentrated to the area exposed to the highest heat load. The long holes allow efficient usage of the cooling air consumption may be reduced. The outlets of the effusion holes have an impingement cooling effect on the burner before the air ends up into the combustion chamber. The groove 31 ensures no cooling holes are blocked by the burner in case of off-axis placement.

Figure 6:
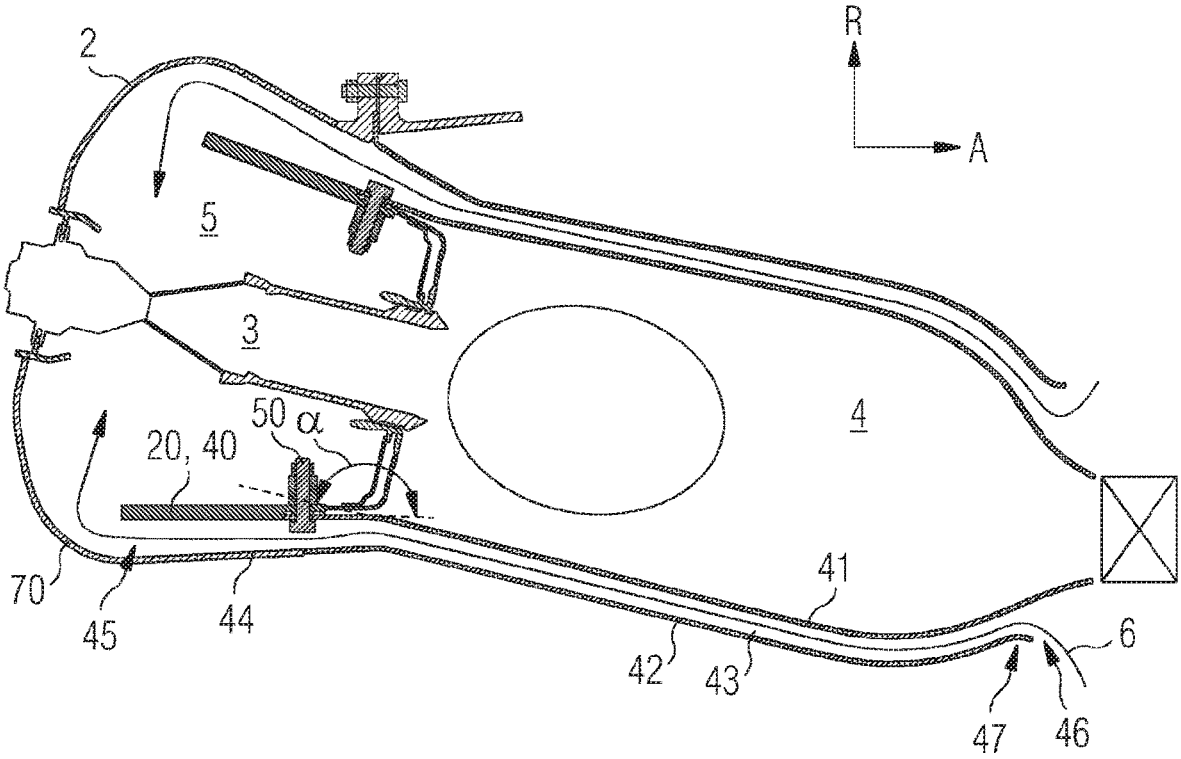
FIG. 6: shows schematically a cross sectional view of a further exemplary inventive combustor arrangement taken at a plane through an axis of a gas turbine.
Figure 7:
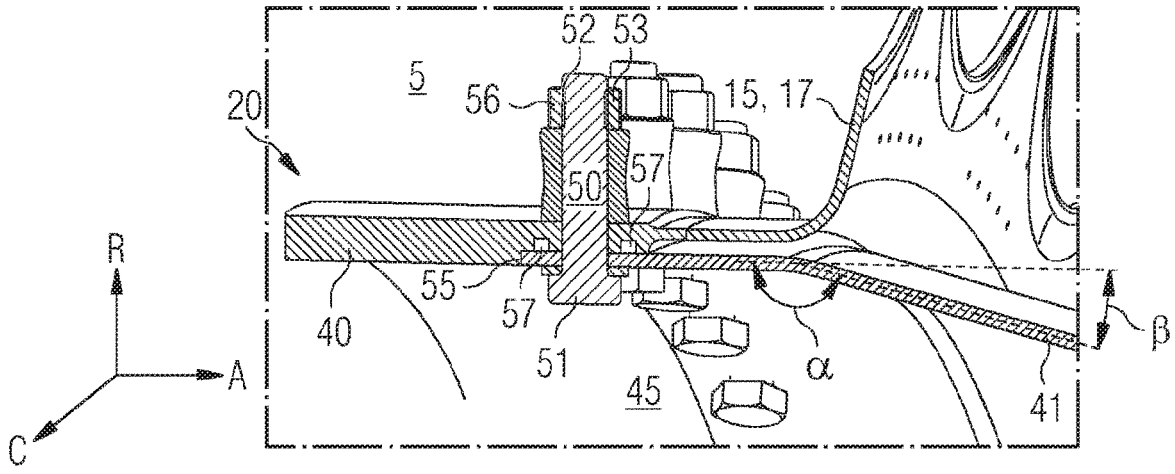
FIG. 7: shows an enlarged three dimensional of bolted connection in as shown in FIG. 6, showing also the cross section of FIG. 6.

In FIGS. 6 and 7, the focus in on the provision of air to the annular housing 2 and how the air is guided along the annular combustion chamber 4. Furthermore maintenance aspects are considered to allow easy access.

Based on the design of FIG. 1, FIG. 6 shows a combustor arrangement comprising the mentioned annular combustion chamber 4 and the mentioned annular space 5. Again a plurality of burners 3 are located in the annular space 5 and are connected to the annular combustion chamber 4. Stiffening plates 10 are present as shown in FIG. 1.

The annular combustion chamber 4 shows a dual wall configuration at a radial inwards and a radial outwards wall. A combustion chamber liner 41 limits the space of the annular combustion chamber 4. In the following the explanation is focusing on the radial inward dual wall structure but all will also apply for the outward dual wall structure.

The dual wall structure comprises the combustion chamber liner 41 and a further wall 42 (a cooling panel), which both limit in between a cooling fluid passage 43. The combustion chamber liner 41 may have cooling features applied to improve convective cooling. In the figure a reverse flow cooling is shown, so that the main direction of the compressed fluid 6 is in opposite direction as a main direction of a combustion product travelling through the annular combustion chamber 4 to a subsequent expansion turbine section.

The cooling fluid passage 43 has an inlet 46 with a smoothly converging wall—i.e. an inlet section 47 of the further wall 42 reduces the distance to the liner 41—such that pressurized compressor discharge air as compressed fluid 6 can enter the cooling fluid passage 43 with minimised pressure losses. When traveling within the cooling fluid passage 43 the compressed fluid 6 convectively cools the combustion chamber liner 41.

Once beyond the combustion chamber 4 the compressed fluid 6 will be led into the annular space 5. The cooling fluid passage 43 will merge into a diffuser (or diffuser) 45 to convert dynamic pressure back to static pressure before the cooling fluid 6 exhausts into the annular space 5 ready to pass through the burner and take part in the combustion. The diffuser 45 is defined by two opposing walls that increase in distance along a main direction of a flow of the compressed fluid 6. The two opposing walls are the first further plate 20 (the liner extension plate) extending into the annular space 5 and the boundary walls 44, the latter being part of the annular housing 2.

By extending into the annular space 5 the first further plate 20 also defines a barrier 40 as a liner extension plate that separates incoming compressed fluid 6 from fluid that already has entered the annular space 5.

The barrier 40 is a continuation or an extension of the combustion chamber liner 41—therefore also called liner extension plate—, but geometrically there will be a bent present by an angle $\alpha$ between a direction of the barrier 40 and a direction of the liner 41. The angle $\alpha$ is advantageously obtuse and for example between 160° and 175°. That means in consequence that the two surfaces have only a slight bent between 5° and 20° (which corresponds to an angle $\beta$ which is shown in FIG. 7).

The diffuser 45 allows reducing a local speed of the compressed fluid 6 before being exhausted into the annular space 5. Dynamic pressure is converted back to static pressure.

A length of the barrier 40 penetrating into the annular space 5 is such that the compressed fluid 6 will be directed to a curved section 70 of the annular housing 2 such that the compressed fluid 6 will be redirected into a central region of the annular space 5 with minimal pressure losses.

In FIG. 6 bolts 50 are shown as a means for connecting the barrier 40 to the combustion chamber liner 41 and to the heat shield 17. This will be explained further in reference to FIG. 7, in which a combined three-dimensional view and a cross-section is shown for a radial inwards wall configuration of the combustor.

In FIG. 7 the barrier 40 comprises an axial stop 55 which corresponds to a width of an end section of the combustion chamber liner 41. The barrier 40 and the combustion chamber liner 41 overlap for a specific overlapping region and the bolts 50 are present in that overlapping region. The bolts 50 will extend through the barrier 40 and the combustion chamber liner 41, such that only a bolt head 51 projects into the space of the diffuser 45. The bolts 50 may be threaded. Nuts 53 will be placed onto the threads 52 of the bolts so that the bolts 55 will be held in place. During assembly and disassembly it may be easy to access the nuts 53 by manually reaching into the annular space 5, for example via opening 62 within the annular housing (see FIG. 2 for that opening 62), when the burner 3 is not put in place.

So that the nuts 52 do not get loose from the bolts 50 caused from vibration an extension sleeve 56 may be present between the nuts 52 and the barrier 40. The extension sleeve 56 will be concentric about the bolt 50. The extension sleeve 56 may have sufficient flexibility so that a continuous force is applied to the nut 52 so that the nut 52 will not get loose.

Rope seals 57 may be placed in the overlapping region between the barrier 40 and the combustion chamber liner 41 so that no compressed fluid 6 can branch off through the bolted connection or even entering the annular combustion chamber 4 and also hot fluid from the annular combustion chamber 4 is blocked.

Typically, a design of a rope seal 57 comprises a metal hose with a core of elastic fibers may be used for sealing in high temperature environments.

Alternatively also a brush seal could be used (not shown).

The impingement plate 17 may be fixed to an axial end of the barrier 40, for example by welding. Alternatively (not shown) the impingement plate 17 may also overlap to the overlapping region so that all three components—the impingement plate 17, the barrier 40, the liner 41—are held together by the bolt 50.

The liners 41 are bolted to the barrier 40 for easy dismantling at repair. The liner 41 and the barrier 40—or a transition ring connected to the barrier 40—may be manufactured to the same diameter with good precision. For assembly, the liners 41 and the barrier 40 are then bolted together using radially oriented bolts 50. The barrier 40 or the transition ring is machined to have an axial stop 55 which allows for accurate axial positioning of the liners 41.

During operation the rope seals 57 or brush seals may be used to minimize eventual leakage through the bolt connection. The extension sleeves 56 may be used for the bolts 50 to get sufficient margin on the bolt strain so the bolts would not get loose due to settling or break due to vibrations or due to too high thermal stresses.

The bolt connection only has a small negative impact on the cooling channels (i.e. the cooling fluid passage 43), not blocking the cooling channels, as only a small bolt head 51 resides in the space of the diffuser 45.

The bolts 50 may be advantageously arranged in radial direction R, the barrier 40 may be advantageously arranged in axial direction A. By this orientation it would be possible to access the bolt heads 51 and the nuts 53 for maintenance of the combustor, e.g. for separating the connected components.

The invention claimed is:

1. A combustor arrangement, the combustor arrangement being annular and being arranged about an axis, the axis defining an axial direction, comprising:

an annular combustion chamber;

an annular housing that houses a plurality of burners and the annular combustion chamber;

the plurality of burners arranged circumferentially about the axis inside the annular housing;

an annular space being defined between the annular housing, the plurality of burners and the annular combustion chamber, the annular space arranged to guide a compressed fluid;

a plurality of stiffening plates, each arranged within the annular housing, wherein two adjacent ones of the plurality of burners are separated by one of the stiffening plates;

a combustor separating wall arrangement separating the annular space from the annular combustion chamber and providing openings for the plurality of burners;

further plates extending into the annular space;

wherein the stiffening plates are arranged angled to, and connected to the combustor separating wall arrangement and two boundary walls of the annular housing, and the further plates, wherein the combustor separating wall arrangement comprises:

the openings which each hold a tip region of a respective burner of the plurality of burners;

a heat shield with cooling holes, the cooling holes arranged for guiding the compressed fluid into the combustion chamber;

an impingement plate parallel to the heat shield and defining a cooling cavity between the heat shield and the impingement plate, the impingement plate comprising further holes for impingement cooling of the heat shield, wherein the further holes are arranged to be supplied with the compressed fluid from the annular space, further comprising burner rings each being located inside one of the openings of the combustor separating wall arrangement, each of the burner rings having a through-hole into which the tip region of the respective burner is mounted, wherein the stiffening plates and the impingement plate are connected fixedly to another; and wherein the impingement plate is slidably locked to each of the burner rings and to the heat shield.

2. The combustor arrangement according to claim 1, wherein the combustor separating wall arrangement comprises a support ring located in the annular space, the support ring comprising the openings of the combustor separating wall arrangement to slidably hold the plurality of burners, wherein the stiffening plates are connected to the support ring.

3. The combustor arrangement according to claim 1, wherein the stiffening plates are manufactured from sheet metal or integrally formed with the annular housing.

4. The combustor arrangement according to claim 1, wherein each of the burner rings comprises elongated effusion cooling holes directed onto the tip region of the respective burner or onto a front face of the tip region of the respective burner, and/or into a groove between a rim of each of the burner rings and the tip region of the respective burner.

5. The combustor arrangement according to claim 1, wherein the further plates comprise at least a barrier penetrating the annular space such that cooling air from a combustion chamber liner is guided to an axial mid region of the annular space, the barrier being a liner extension plate of the combustion chamber liner.

6. The combustor arrangement according to claim 5, wherein the liner extension plate and the combustion chamber liner are angled to another via an obtuse angle between 155° and 180°.

7. The combustor arrangement according to claim 5, wherein a further wall of the annular housing and the combustion chamber liner define a cooling fluid passage there-between with a cooling fluid passage cross-section, the cooling fluid passage leading into a diffuser, the diffuser being defined by one of the two boundary walls of the annular housing and the liner extension plate.

8. The combustor arrangement according to claim 7, wherein an inlet into the cooling fluid passage is defined by a section of the further wall smoothly becoming parallel, in respect of a cooling fluid flow direction along the liner during operation, to the liner of the combustion chamber.

9. The combustor arrangement according to claim 7, wherein the liner extension plate and the combustion chamber liner are connected via bolts.

10. The combustor arrangement according to claim 7, wherein the liner extension plate and the combustion chamber liner and the combustor separating wall arrangement are connected via bolts.

11. The combustor arrangement according to claim 10, wherein a contact region between a connection of the liner extension plate and the combustion chamber liner and the combustor separating wall arrangement is sealed by means of rope seals or brush seals in order to minimize leakage from the annular housing to the annular combustion chamber through the contact region.

12. The combustor arrangement according to claim 9, wherein the bolts comprise bolt heads and threads, and wherein the bolts are configured such that the bolt heads extend into the diffuser and/or the threads extend into the annular space, or the bolt heads extend into the diffuser and/or the threads extend into the cooling fluid passage.

13. The combustor arrangement according to claim 9, wherein the bolts are fastened via nuts applied from the annular space.

14. The combustor arrangement according to claim 9, wherein the barrier provides an axial stop for engaging the combustion chamber liner with the barrier.

15. The combustor arrangement according to claim 9, wherein a contact region between a connection of the liner extension plate and the combustion chamber liner is sealed by means of rope seals or brush seals in order to minimize leakage from the annular housing to the annular combustion chamber through the contact region.

16. The combustor arrangement according to claim 13, wherein an extension sleeve is provided for each of the bolts positioned between one of the nuts and the barrier for providing continuous strain on each of the bolts.

17. The combustor arrangement according to claim 1, wherein the angular arrangement is perpendicular.

* * * * *